US008246430B1

(12) United States Patent
Paynton et al.

(10) Patent No.: US 8,246,430 B1
(45) Date of Patent: Aug. 21, 2012

(54) CHIMNEY CAP

(75) Inventors: William C. Paynton, North Attleboro, MA (US); Richard H. Paynton, North Attleboro, MA (US)

(73) Assignee: Improved Consumer Products, Inc., Attleboro Falls Village, MA (US)

( * ) Notice: Subject to any disclaimer, the term of this patent is extended or adjusted under 35 U.S.C. 154(b) by 707 days.

(21) Appl. No.: 12/478,838

(22) Filed: Jun. 5, 2009

(51) Int. Cl.
*F23J 13/08* (2006.01)

(52) U.S. Cl. ..... 454/4; 454/3; 454/44

(58) Field of Classification Search ..... 454/1, 3–4, 454/7, 13–14, 16, 30, 35, 44, 46–47
See application file for complete search history.

(56) References Cited

U.S. PATENT DOCUMENTS

| | | | | |
|---|---|---|---|---|
| 329,993 | A * | 11/1885 | Barker | 454/12 |
| 1,301,096 | A | 4/1919 | Brockest | |
| 1,783,406 | A | 12/1930 | Cibulas | |
| 1,888,290 | A | 11/1932 | Rhinow | |
| 2,242,468 | A | 5/1941 | Holub | |
| 2,381,178 | A | 8/1945 | Munyon | |
| 2,628,551 | A * | 2/1953 | Leigh | 454/366 |
| 2,878,838 | A | 3/1959 | Budge et al. | |
| 2,988,982 | A | 6/1961 | Edmund | |
| 2,994,260 | A | 8/1961 | Millett | |
| 3,874,363 | A * | 4/1975 | Biedenbender et al. | 126/85 B |
| 4,325,291 | A | 4/1982 | Paynton et al. | |
| 4,384,617 | A | 5/1983 | Mueller | |
| 4,466,340 | A * | 8/1984 | Briner | 454/46 |
| 4,549,473 | A * | 10/1985 | Alexander et al. | 454/14 |
| 4,697,500 | A * | 10/1987 | Hisey | 454/35 |
| 4,777,871 | A | 10/1988 | Stowell | |
| 4,846,512 | A | 7/1989 | Karakawa | |
| 4,878,326 | A | 11/1989 | Sass | |
| 1,337,731 | A | 4/1990 | Speaks | |
| 5,025,712 | A * | 6/1991 | Perry | 454/35 |
| 5,234,582 | A * | 8/1993 | Savoie | 210/163 |
| 5,609,522 | A | 3/1997 | Szwartz | |
| 6,852,023 | B2 | 2/2005 | Hediger et al. | |
| 7,014,555 | B1 | 3/2006 | Issod | |
| 7,713,114 | B1 * | 5/2010 | Paynton et al. | 454/12 |

FOREIGN PATENT DOCUMENTS

| | | | |
|---|---|---|---|
| EP | 0182534 | | 5/1986 |
| GB | 2166537 A | * | 5/1986 |

* cited by examiner

*Primary Examiner* — Steven B McAllister
*Assistant Examiner* — Jamil Decker
(74) *Attorney, Agent, or Firm* — John Brooks Law LLC; John J. Brooks, III

(57) ABSTRACT

A chimney cap capable of being secured to a chimney and including a base; an annular collar member for insertion into a chimney, and having an outside circumference smaller than an opening of the chimney so as to be readily received therein; an annular shaped mesh member that is supported about the collar; a top supported over the base; and a plurality of support rods attached to the collar and for the purpose of supporting the annular shaped mesh member. The annular shaped mesh member has discharge openings for air flow and at least one elongated slot through which one of the support rods extends for securing the annular shaped mesh member. The elongated slot in combination with the one support rod enables adjustment of the diameter of the annular shaped mesh member.

20 Claims, 15 Drawing Sheets

CHIMNEY CAP

TECHNICAL FIELD

The present invention relates generally to chimney caps and more particularly to an improved chimney cap that is adapted for use with air cooled chimneys.

BACKGROUND OF THE INVENTION

Chimney caps are presently provided in many different shapes and forms. In one sense chimney caps can be basically broken down into two categories, namely those used with regular or non-air-cooled chimney structures and those used with air-cooled chimney structures. Presently, there are two separate cap designs that are used, one for use with non-cooled chimney structures and a different cap for use with air cooled chimney structures. By way of example these different types of chimney caps are shown in the 2005 Product Catalog of Improved Consumer Products, Inc. on page 12 and identified as respective models WSA and WSA-TDW.

One of the problems associated with installing chimney caps is that they are required to fit into chimneys or flues of different size, type and style. Existing chimney caps are not well suited for this installation.

Accordingly, it is an object of the present invention to provide an improved chimney cap in which the chimney cap can be more readily installed to a variety of different size chimneys or flues.

Another object of the present invention is to provide an improved chimney cap in which a mesh screen in particular is adjustable and readily securable to the chimney structure.

SUMMARY OF THE INVENTION

The foregoing and other objects of the invention are attained by a chimney cap capable of being secured to a chimney or flue preferably of an air cooled type chimney structure. The chimney cap comprises a base; an annular collar member for insertion into a chimney or flue, and having an outside circumference smaller than an opening of the chimney or flue so as to be readily received therein; an annular shaped mesh member that is supported about the collar; a top supported over the base and a plurality of support rods attached to the collar and for the purpose of supporting the annular shaped mesh member. The annular shaped mesh member has discharge openings for air flow and at least one elongated slot through which one of the support rods extends for securing the annular shaped mesh member. The elongated slot in combination with the one support rod enables adjustment of the diameter of the annular shaped mesh member.

In accordance with other aspects of the present invention the annular shaped mesh member may comprise a mesh grid pattern having openings that are square or rectangular; the elongated slot may be formed by an elongated opening that extends across several squares or rectangles of the discharge openings; the elongated slot may extend circumferentially about a portion of the total circumference of the annular shaped mesh member; the annular shaped mesh member preferably has opposed ends that overlap and that have at each end thereof aligned elongated slots that, once overlapped, define the elongated slot of the annular shaped mesh member; the end slots preferably terminate short of the opposed ends of the annular shaped mesh member; the annular collar member preferably has an overlap joint; the overlap joint may include a lower segment that extends substantially longitudinal of said collar member and a top segment that extends diagonal to the lower segment enabling compression of the diameter of the collar member; and may further include means for securing an inner end of each support rod to the collar, along with a clip for securing an outer end of each support rod to a fixed chimney structure.

In another version of the invention there is provided a chimney cap capable of being secured to a chimney and comprising: an annular collar member for insertion into the chimney, having an outside circumference smaller than an opening of the chimney and for enabling support of the annular collar member in the chimney; a base having a central opening that is fitted over the annular collar member and that is disposed about the annular collar member between respective top and bottom ends of the annular collar member and an annular open member that is adapted for support over the chimney and under the base. The annular open member may have plural apertures for the passage of exhaust gas from the chimney. The cap further includes a plurality of support posts attached at one end thereof to the collar member and extending radially from the annular collar member. The annular open member further may have at least one elongated slot through which one of the support posts extends for holding the annular open member in place. The elongated slot in combination with the at least one support rod enables adjustment of the diameter of the annular open member.

The chimney cap may also include a top supported over the base by means of a plurality of spacers; the annular collar member may have an overlap joint including a lower segment that extends substantially longitudinal of the collar member and a top segment that extends diagonal to the lower segment enabling compression of the diameter of the collar member; the annular open member may comprise a mesh grid pattern having openings that are square or rectangular; the elongated slot may be formed by an elongated opening that bridges several of the apertures and wherein the elongated slot extends circumferentially about a portion of the total circumference of the annular open member; the annular open member may have opposed ends that overlap and that have at each end thereof aligned elongated slots that, once overlapped, define the elongated slot of the annular shaped mesh member; the end slots may terminate short of the opposed ends of the annular open member, leaving at least one aperture at each end; may include means for securing an inner end of each support post to the annular collar member, and a clip for securing an outer end of each support post to the chimney; the clip may include a first fastener to secure the clip with the support post and a second fastener for securing the clip with the chimney; there may be at least three support posts disposed radially about the annular collar member; and the annular open member may have apertures that are any one of square, rectangular, oval, circular, and diamond-shaped.

DESCRIPTION OF THE DRAWINGS

These and other objects, advantages and novel features of the present invention will become apparent from the following detailed description of the invention when considered in conjunction with the accompanying drawings, in which.

DETAILED DESCRIPTION

Reference is now made to the drawings for an illustration of a chimney cap structure that is constructed in accordance with the principles of the present invention. Most of the different components that comprise a chimney cap are constructed of a lightweight metal material that may be formed from lightweight sheet metal. The adjustable mesh that is described hereinafter, is also preferably constructed of a lightweight metal material and may be in many different forms.

Figure 1:
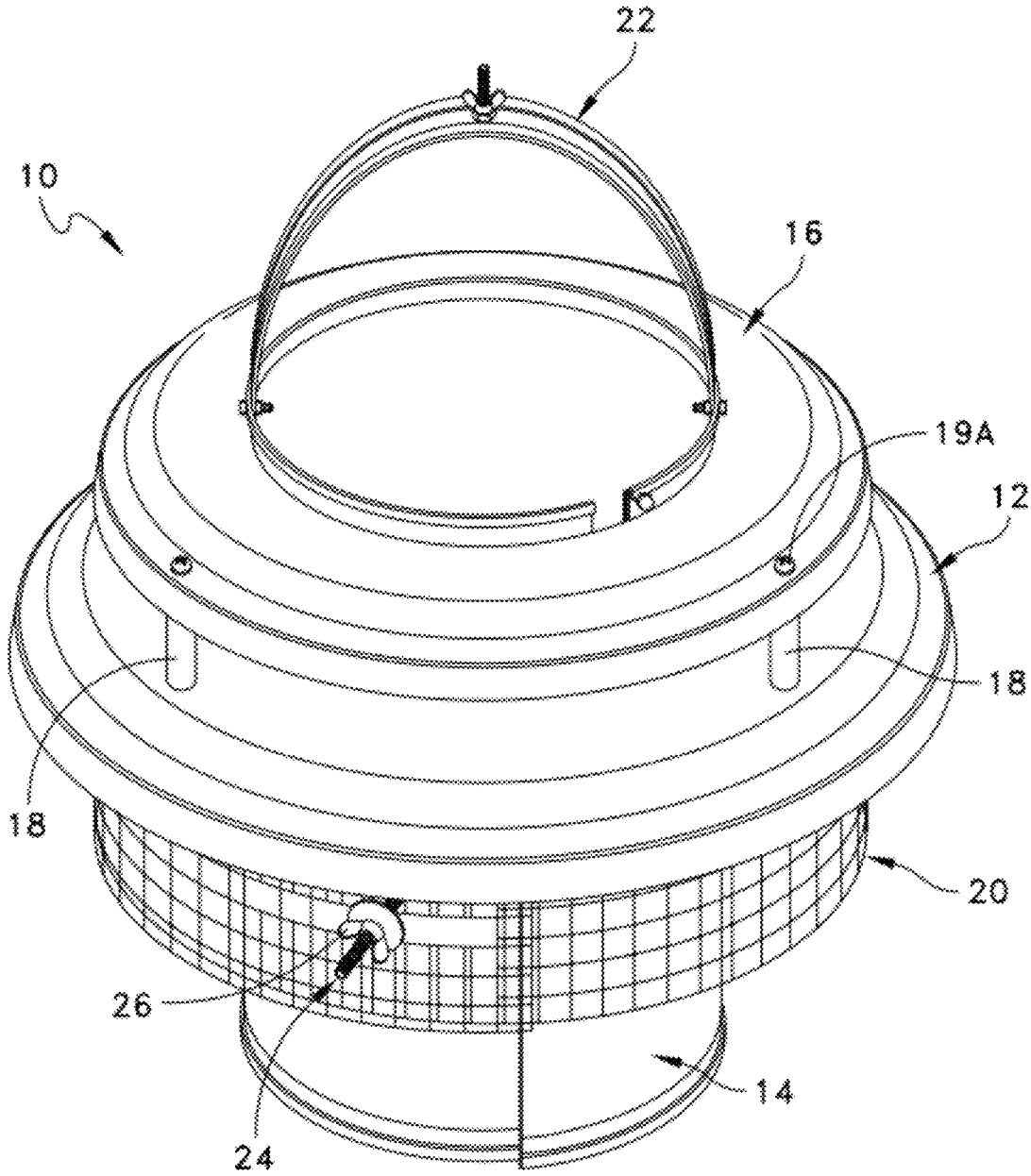
FIG. 1 is a perspective view of a chimney cap constructed in accordance with the present invention.
Figure 2:
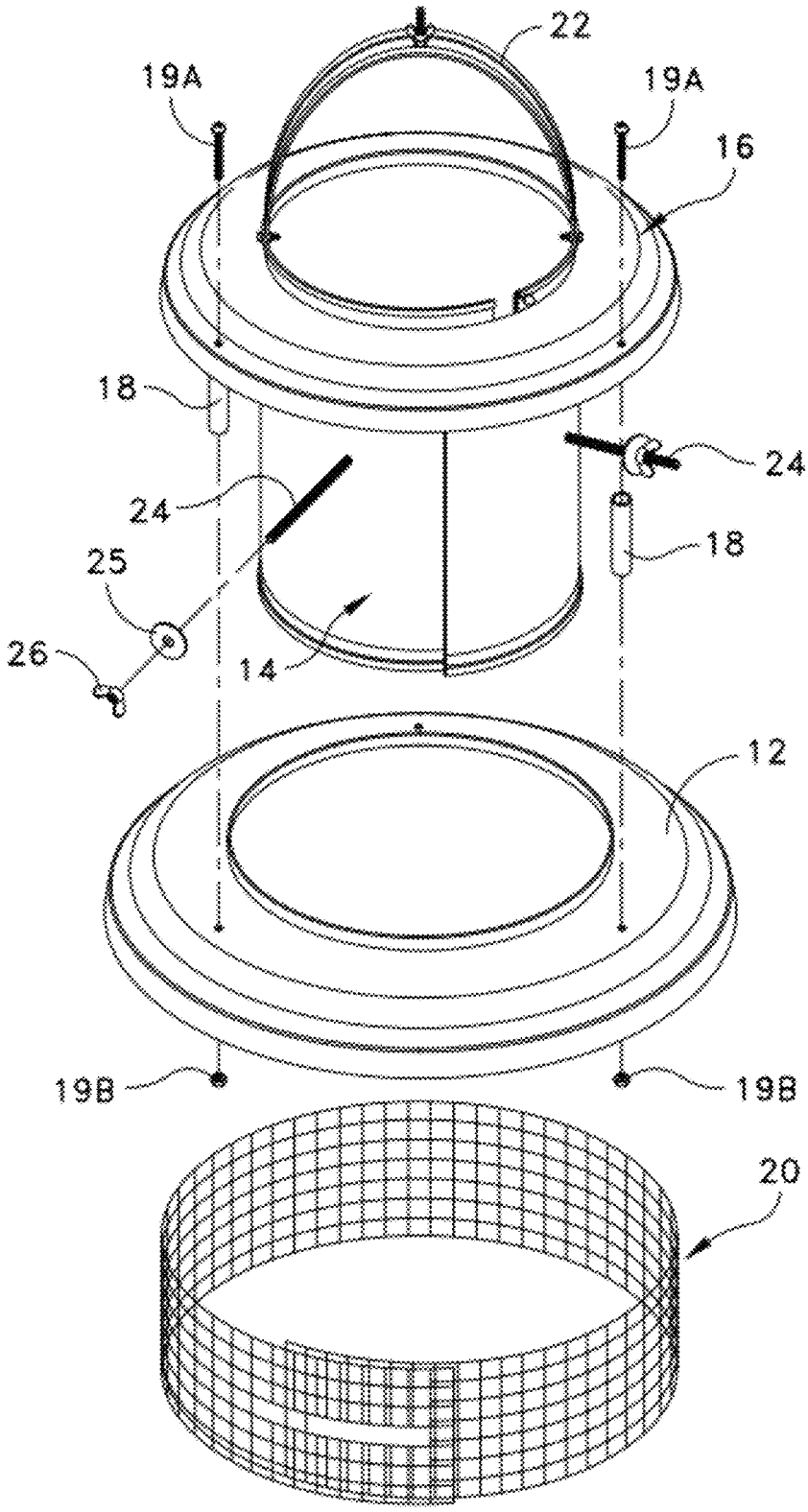
FIG. 2 is an exploded perspective view of the chimney cap of FIG. 1.
Figure 3:
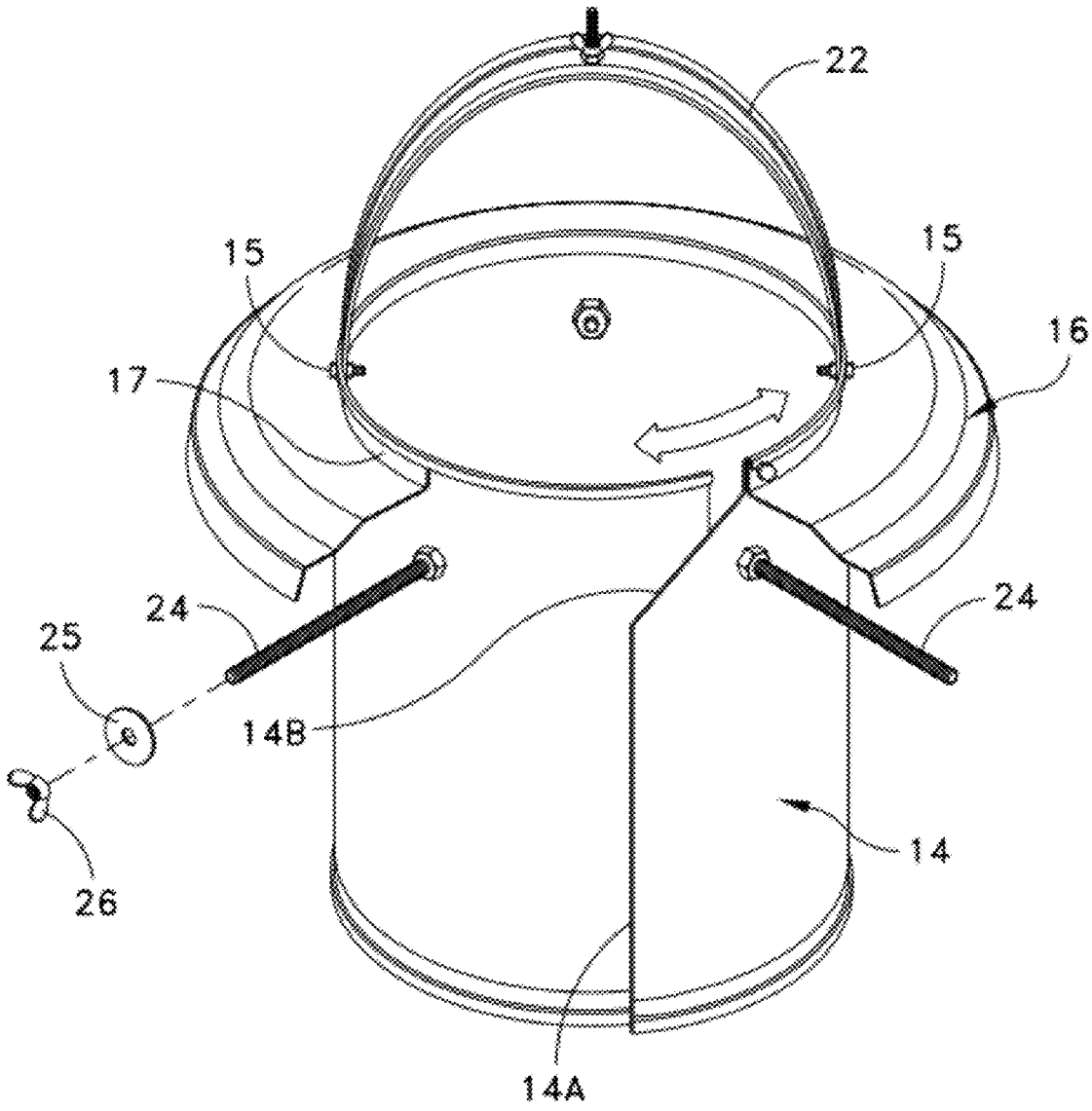
FIG. 3 is a perspective view partially cut away to show a portion of the chimney cap construction of the present invention.
Figure 4:
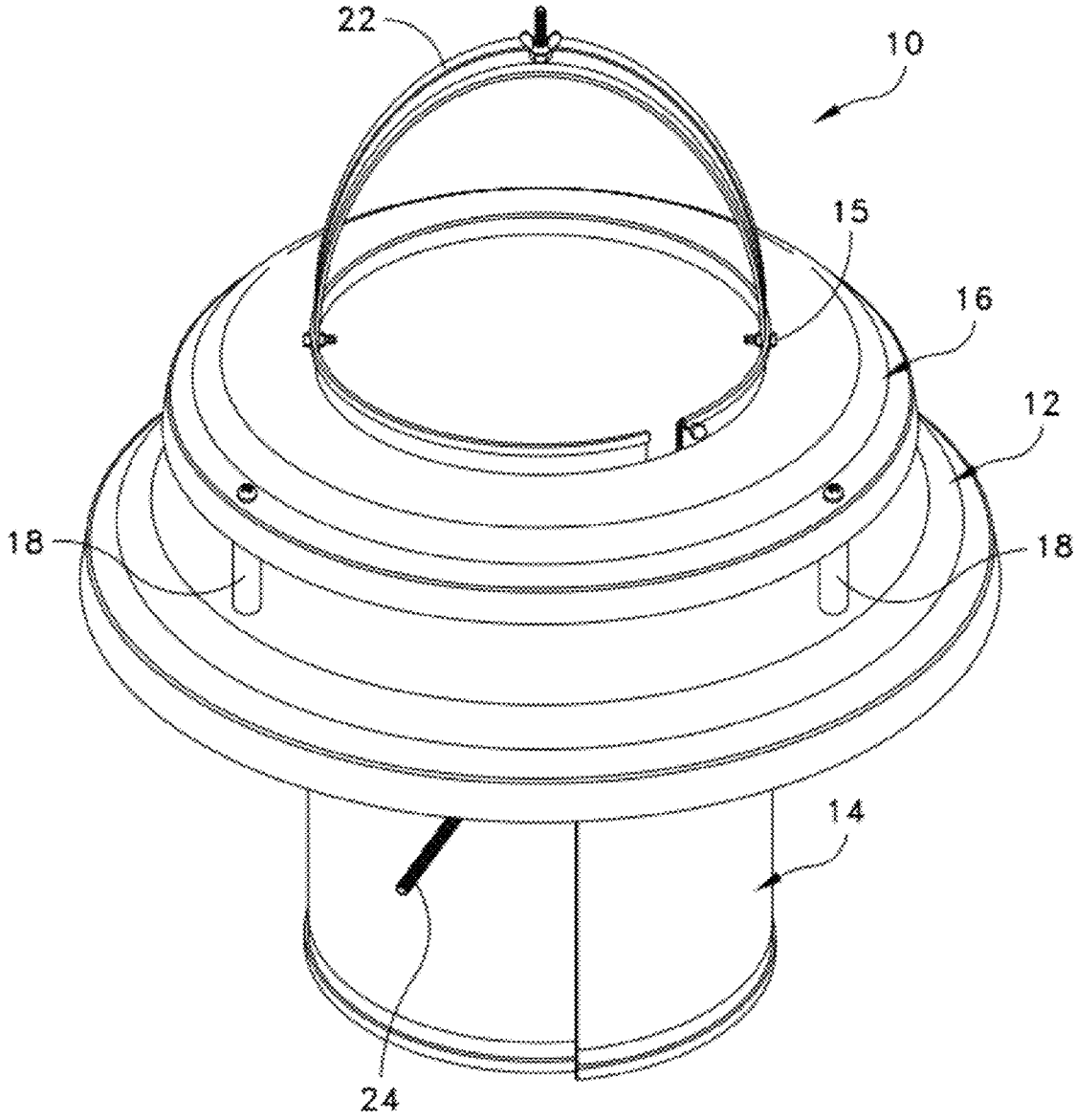
FIG. 4 is a perspective view of a portion of the chimney cap construction of the present invention.
Figure 5:
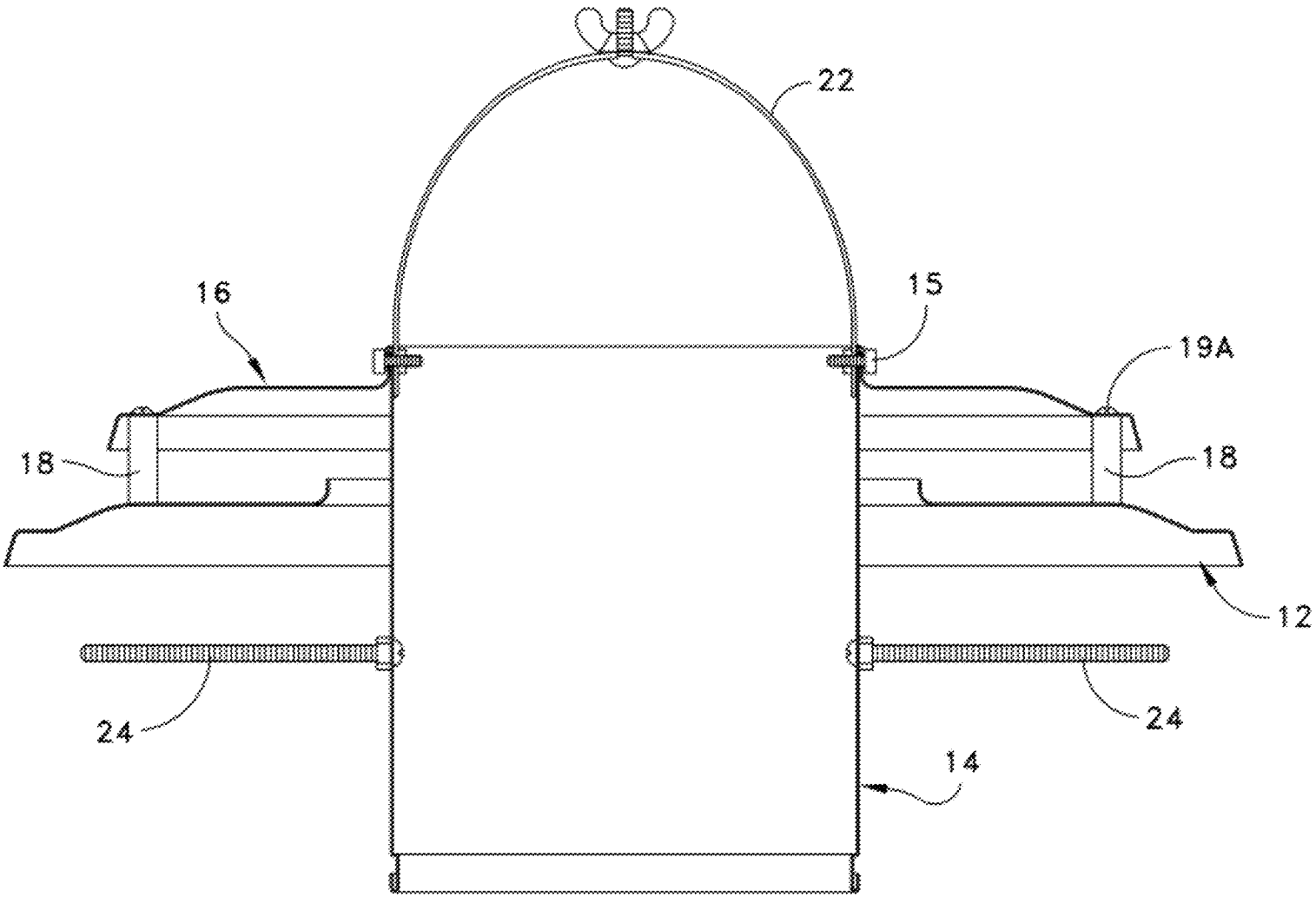
FIG. 5 is a side elevation view of the chimney cap illustrated in FIGS. 1-4.

The chimney cap 10 is illustrated in the drawings as including a base 12 having a central opening that receives and supports the collar 14. Alternatively, the collar 14 may be supported primarily from the top 16. In this regard, FIGS. 1-3 illustrate the collar 14 at its top circumferential edge secured with a flange 17 of the top 16. FIG. 3, for example, also illustrates a pair of bolts or screws at 15 for securing the collar with the top 16 while at the same time also securing in place the support hoop 22. The support hoop 22 may support other chimney cap components such as an additional mesh screen (not shown). In this regard, refer to co-pending application Ser. No. 11/879,436 filed on Jul. 17, 2007 which is hereby incorporated by reference herein in its entirety.

FIG. 2 illustrates, in an exploded perspective view, the various components that comprise the chimney cap. FIG. 2 illustrates the series of posts 18 which are for the support of the top 16 relative to the base 12. Bolts 19A pass through the post 18 and are secured with the base by means of respective nuts 19B. In the embodiment illustrated herein, there are three such support posts 18 that are provided. In alternate embodiments of the invention, other numbers of posts may be provided preferably equally spaced about the perimeter of the base 12.

FIG. 3 also illustrates the collar 14 as having a longitudinal edge 14A that leads into a tapered edge 14B. The edges 14A and 14B provide a lap joint. The diagonal portion 14B enables more ready compression of the diameter of the collar 14.

Figure 12:
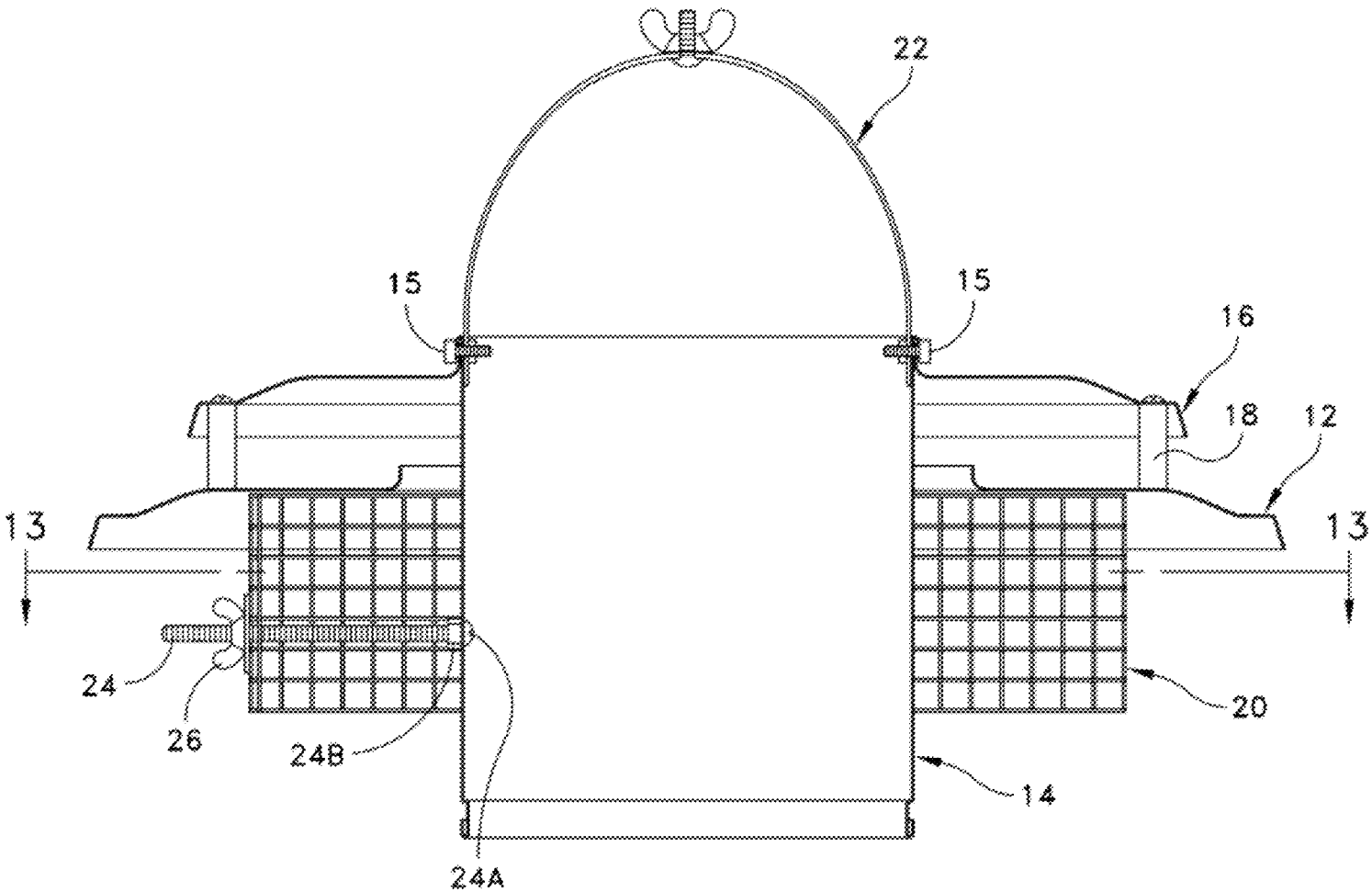
FIG. 12 is a side elevation view of the chimney cap of the present invention with the mesh installed.
Figure 15:
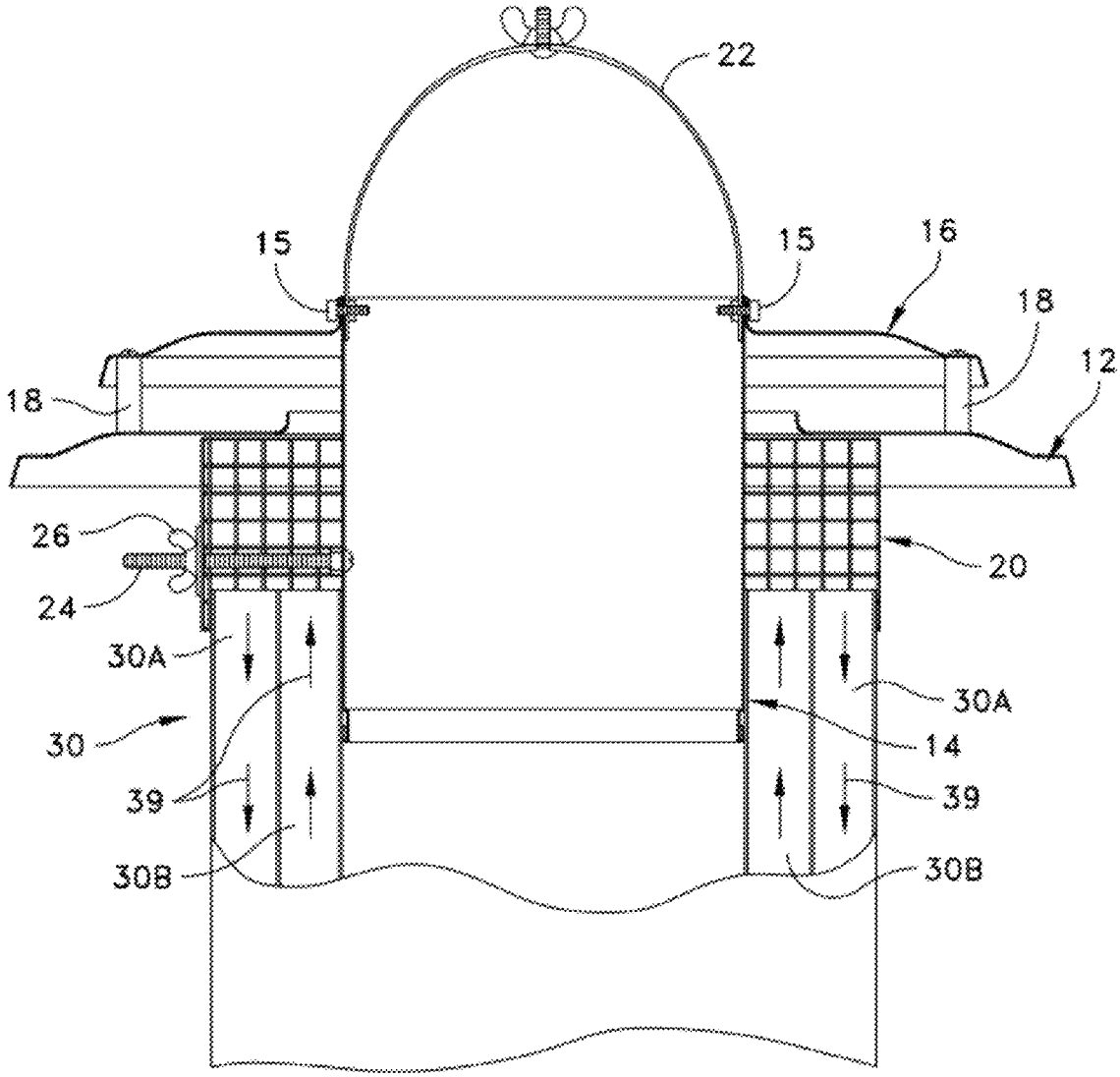
FIG. 15 is a side view illustrating the chimney cap of the present invention as installed over an air cooled chimney structure.

Reference is now made to, for example, FIGS. 12 and 15 that show a more complete chimney cap construction. FIG. 15 in particular illustrates the chimney cap with the collar 14 inserted into the flue structure illustrated at 30 in FIG. 15. As illustrated in FIG. 15, the flue structure 30 is an air-cooled flue or chimney structure having separate ducts 30A and 30B. Arrows 39 illustrate an air flow pattern through the air cooled chimney structure.

Figure 13:
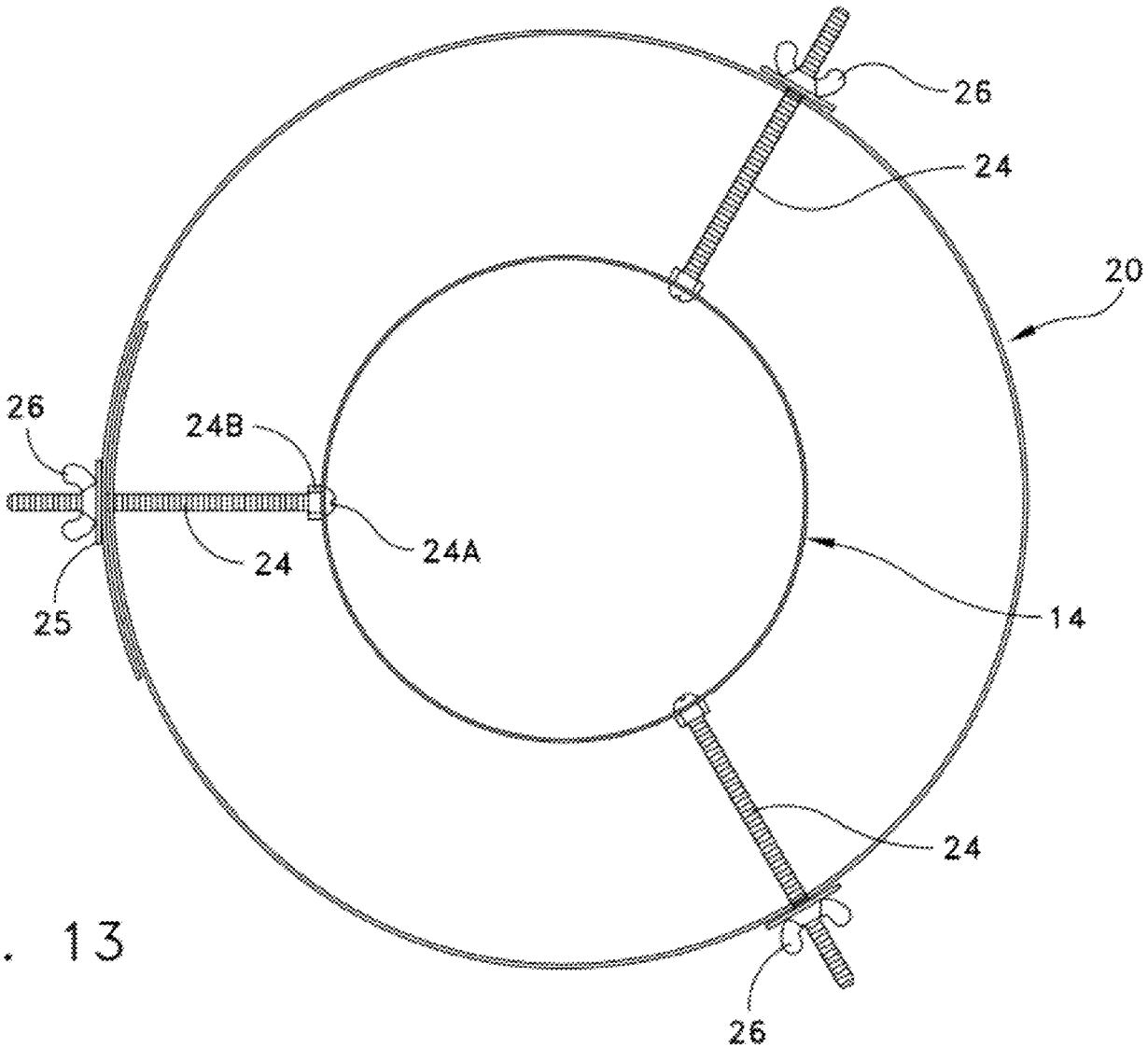
FIG. 13 is a plan view illustrating the use of three securing bolts taken along line 13-13 of FIG. 12.
Figure 14:
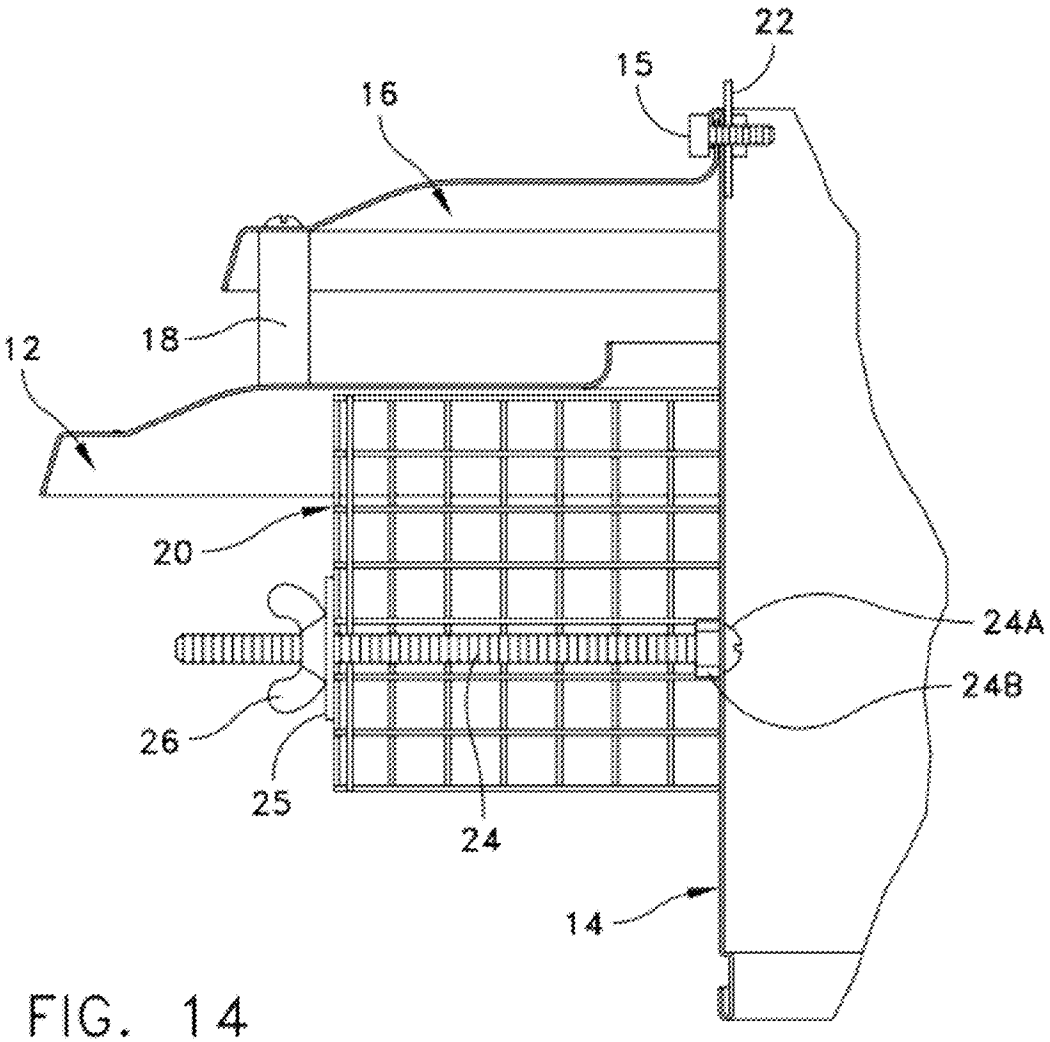
FIG. 14 is a fragmentary view illustrating one of the securing bolts as associated with the mesh structure.

FIGS. 1 and 12 illustrate the mesh 20 as supported below the base 12. The primary support of the mesh structure is by means of a series of bolts 24 that are each supported from the collar 14 and each extend radially. In this regard refer to the cross-sectional view of FIG. 13 that illustrates one embodiment for the placement of the bolts 24. This illustrates the bolt head 24A as secured to the collar member 14. For that purpose a nut 24B may be tightened against the head 24A. At the outer end of each of the bolts 24 there may be provided a washer 25 and a wingnut 26 that engages with the threaded bolt 24. In the drawings three such support bolts 24 are provided. At a minimum it is preferred to have at least two bolts 24 diametrically disposed to each other. Also, greater than three bolts may also be employed. It is preferred that the bolts be evenly spaced about the perimeter of the base and collar. Refer to FIG. 13 for an illustration of the use of three bolts 24 being disposed each at a relative spacing of 120 degrees to the adjacent one thereof. The wing nuts 26 are tightened against the washer 25 to hold the mesh screen in place.

Reference is now made to FIGS. 6-11 for further explanations relating to the mesh 20. The mesh 20 is in the form of a wire grid and in the illustrated embodiment is comprised of a series of longitudinal and latitudinal wires that form square or rectangular grid openings or apertures 21. In one embodiment of the mesh construction illustrated in FIGS. 7 and 8 at opposed ends 23 there are provided respective elongated slots 40. These slots 40 do not extend to the very edge 23. For example, in the embodiment illustrated in FIGS. 7 and 8, each of the slots terminates before the edge 23 leaving at least one grid member such as illustrated at 41 in FIG. 7.

Figure 8:
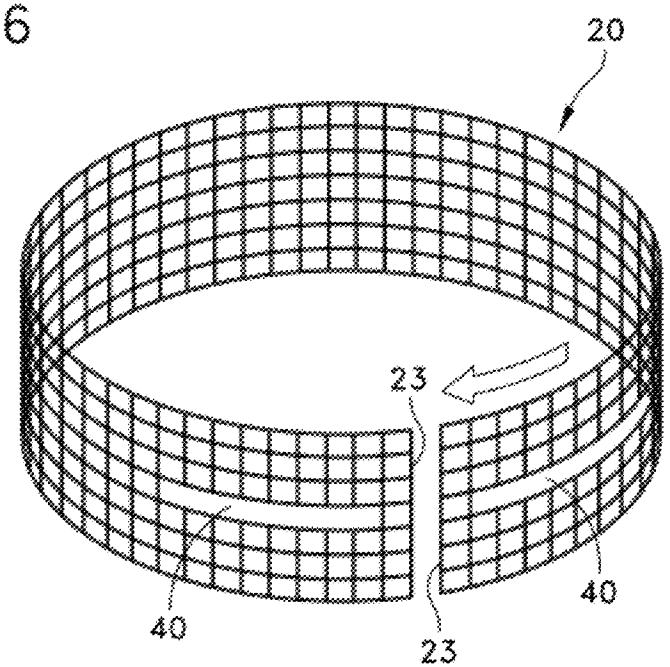
Figure 7:
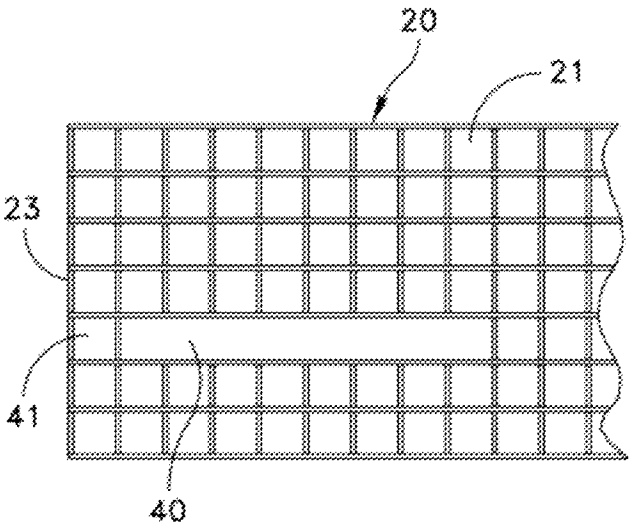
Figure 9:
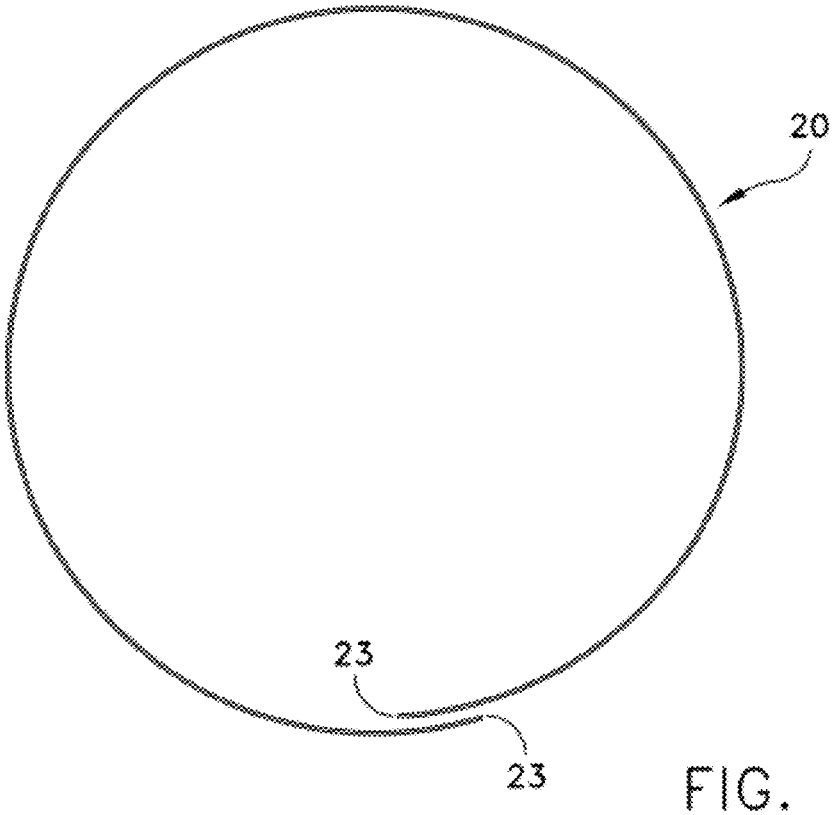
FIGS. 9 and 10 are plan views illustrating the manner in which the diameter of the mesh structure may be adjusted.
Figure 10:
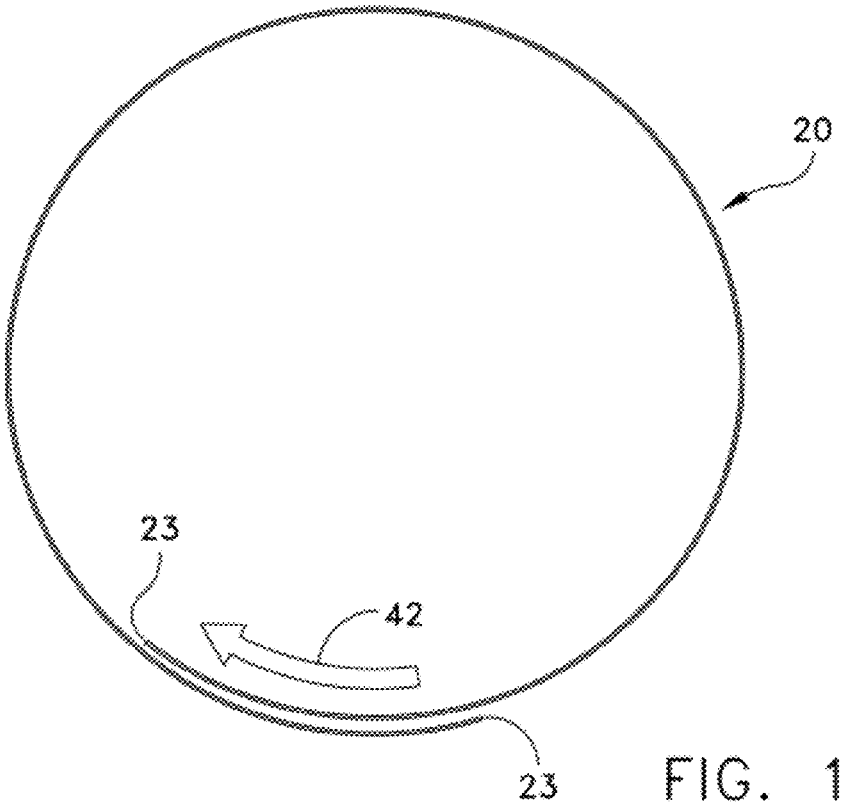
Figure 11:
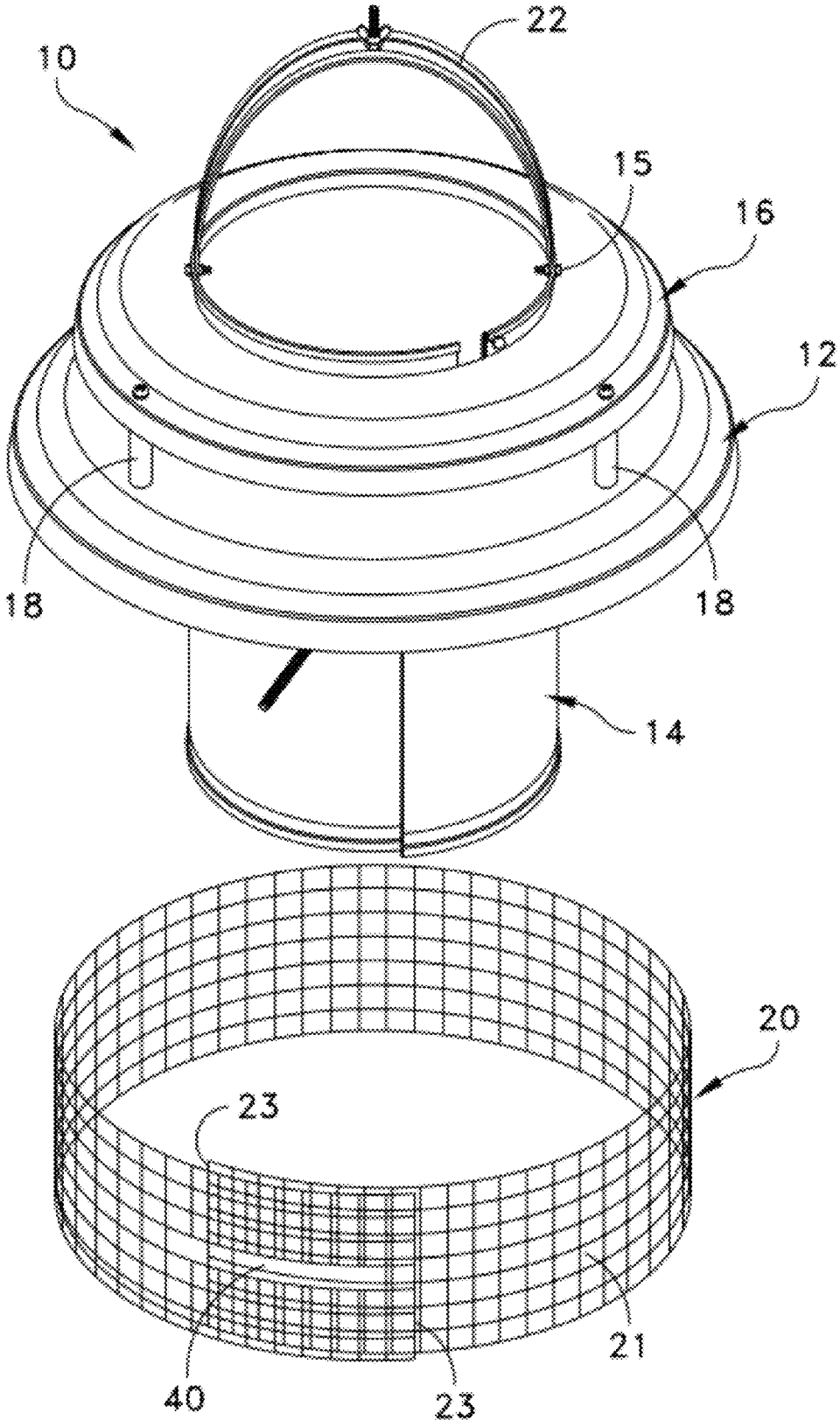
FIG. 11 is an exploded perspective view illustrating the novel mesh structure of the present invention as disposed under the base of the chimney cap construction.

In the embodiment illustrated in FIGS. 7 and 8, the ends 23 are meant to overlap such as illustrated in FIGS. 9 and 10 so that the slots 40 can likewise overlap as is illustrated in FIG. 11. As noted in FIGS. 7-11, there is essentially only a single overlapping slot 40, provided once the edges 23 are made to overlap such as particularly shown in FIG. 10. FIG. 10 also illustrates by the arrow 42 the manner in which the overlapping can be changed so as to change the overall diameter of the mesh structure 20. In this way, the mesh structure 20 can be more readily fitted to the chimney structure. In this regard refer to FIG. 15 that shows the mesh structure as fitted about the top of the chimney structure 30. Refer also to FIG. 17 that shows the bottom of the mesh structure 20 fitted over the top edge of the collar 14. Thus, in accordance with the present invention there is provided a relatively simple way of adjusting the diameter of the mesh structure 20 so that it can match a different size flue or chimney structure. The wing nut 25 may then be screwed inwardly so as to hold the mesh structure 20 at the proper position such as illustrated in FIGS. 15-17.

Figure 6:
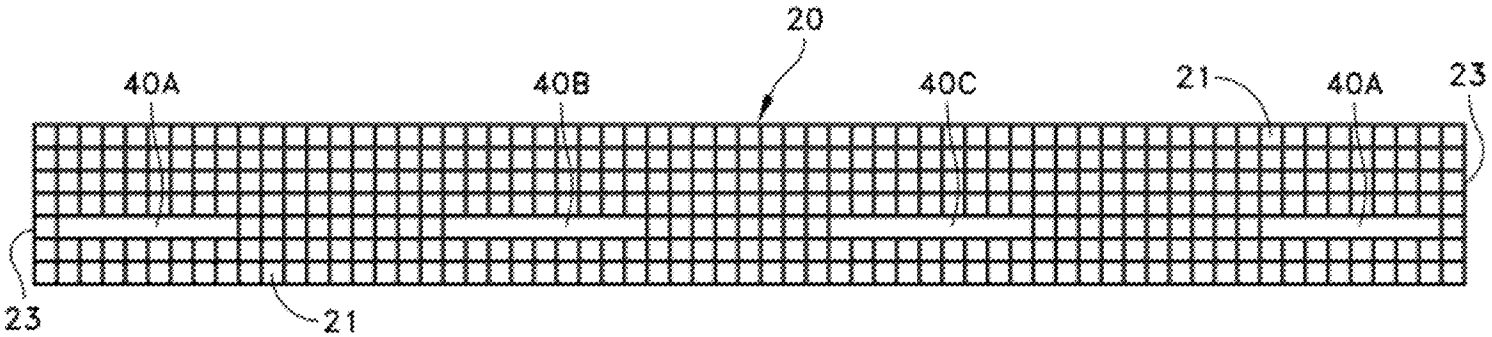
FIGS. 6-8 illustrate the mesh construction.

Thus, in one embodiment of the present invention a single pair of overlapping slots 40 is provided to set the diameter adjustment of the mesh structure 20. An alternate embodiment is illustrated in FIG. 6 in which there are end slots 40A but also toward the middle of the mesh structure respective slots 40B and 40C. The slots 40B and 40C may be shorter in length than each of the slots 40A. The embodiment illustrated in FIG. 6 is meant for a chimney structure in which there are three support bolts or rods 24. By providing the multiple slots illustrated in FIG. 6, this provides some additional latitude as far as the adjustment of the diameter is concerned. One bolt would be accommodated in the end slots 40A and second and third bolts would be accommodated in respective slots 40B and 40C.

Figure 16:
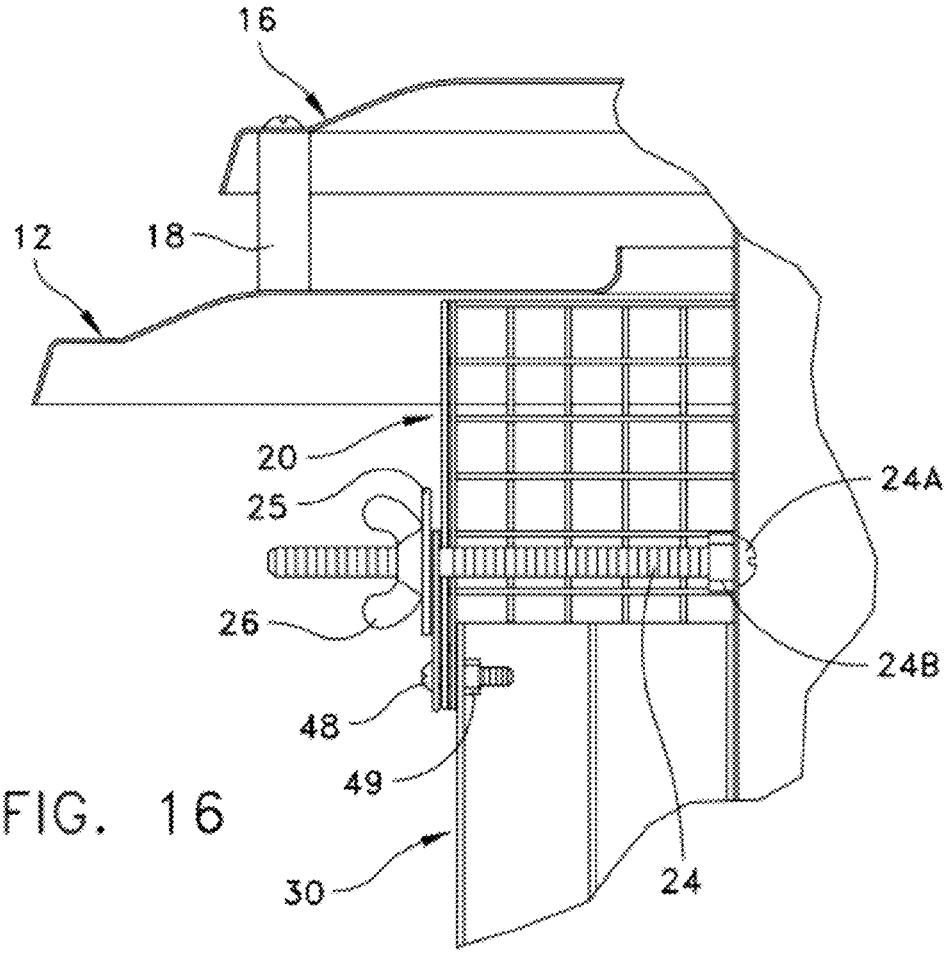
FIGS. 16-18 are fragmentary views illustrating means for attaching the mesh structure to the chimney structure.
Figure 17:
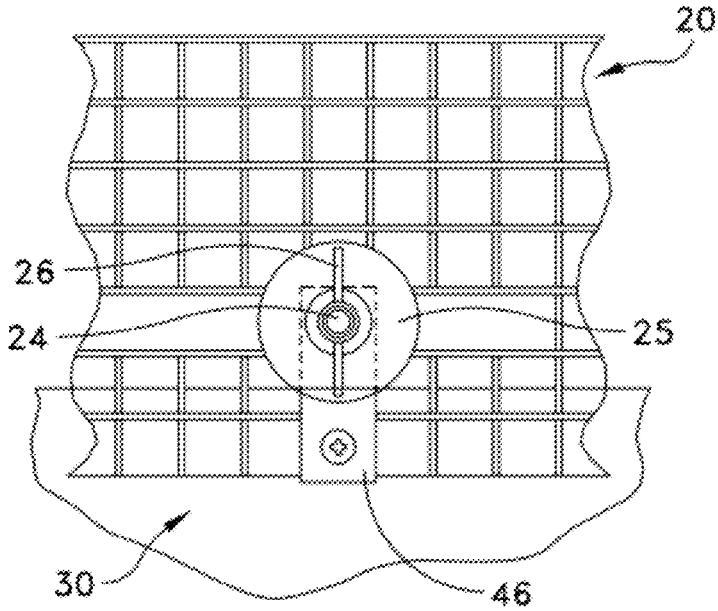

Reference is now made to FIGS. 16 and 17 for a further means that is used for securing the mesh structure 20 to the chimney structure 30. This includes a clip 46 having opposed holes. One hole extends over the bolt 24 and under the washer 25. The other hole at the bottom end of the clip viewed in FIGS. 16 and 17 receive a securing bolt 48 and associated nut 49. The bolt 48 passes through a hole in the chimney structure 30. This arrangement provides for a closure of the mesh structure 20 to the proper diameter while also securing the bolt 24 and mesh to the chimney structure by means of the clip 46.

Figure 18:
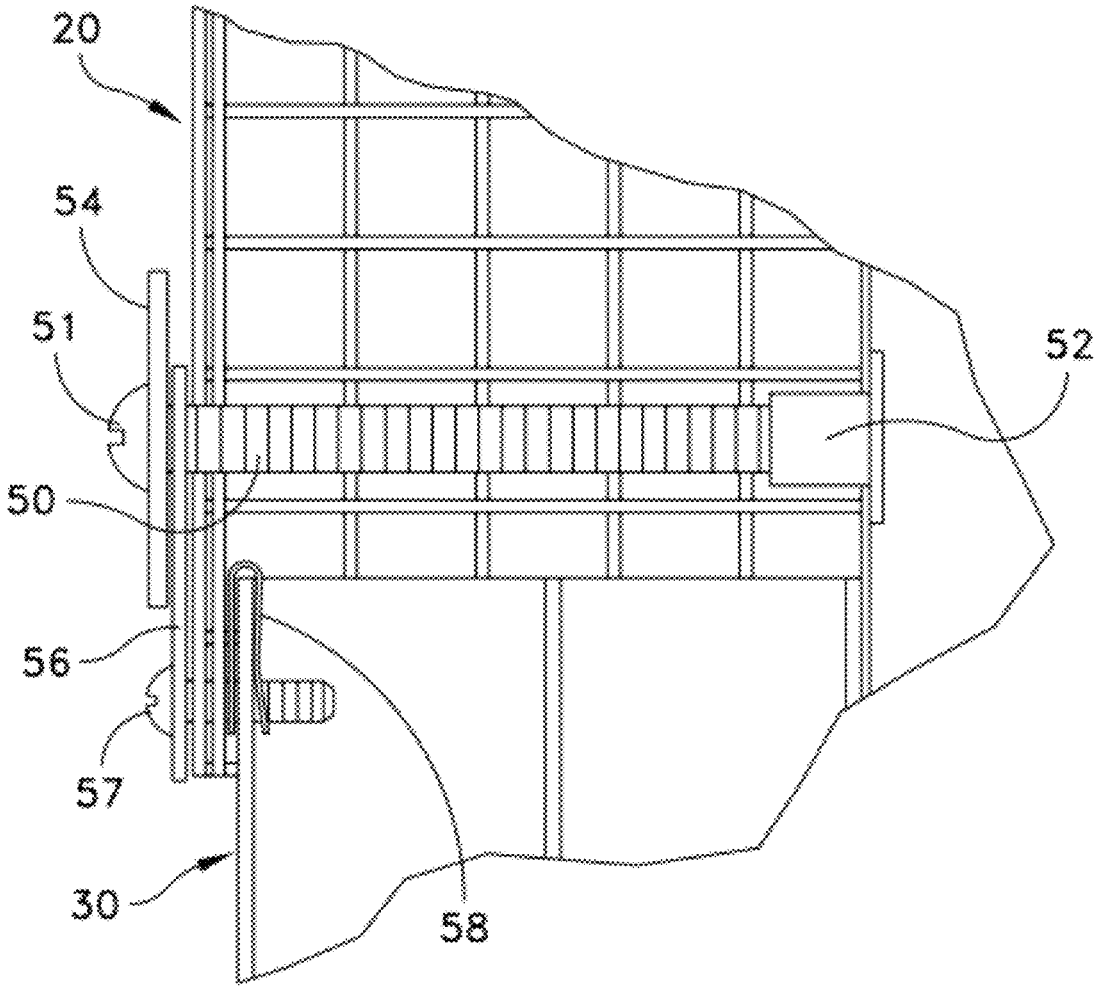

Reference is now made to FIG. 18 for a slightly different version of a fastener means for securing the mesh structure 20 in place. This includes a bolt 50 that is received by the fixed nut 52. The nut 52 is internally threaded and is secured to the collar 14. The bolt 50 is adapted to thread into the nut 52. At the head 51 of the bolt there is preferably provided a washer 54. The embodiment of FIG. 18 also includes a clip 56 that is secured at one end with the bolt 50 and that extends at the other end so as to be secured to the chimney structure 30 by means of a smaller bolt 57. The bolt 57 is secured to the chimney structure with the use of a clip 58. The clip 58 may simply be slid over a top edge of the chimney structure as illustrated in FIG. 18. The clip 58 functions as a nut for receiving and securing the bolt 57. The bolt 57 passes through a lower disposed hole in the clip 56, through the mesh structure 20 and also through the clip 58, and a hole that may be drilled at the top end of the chimney structure 30.

Figure 19:
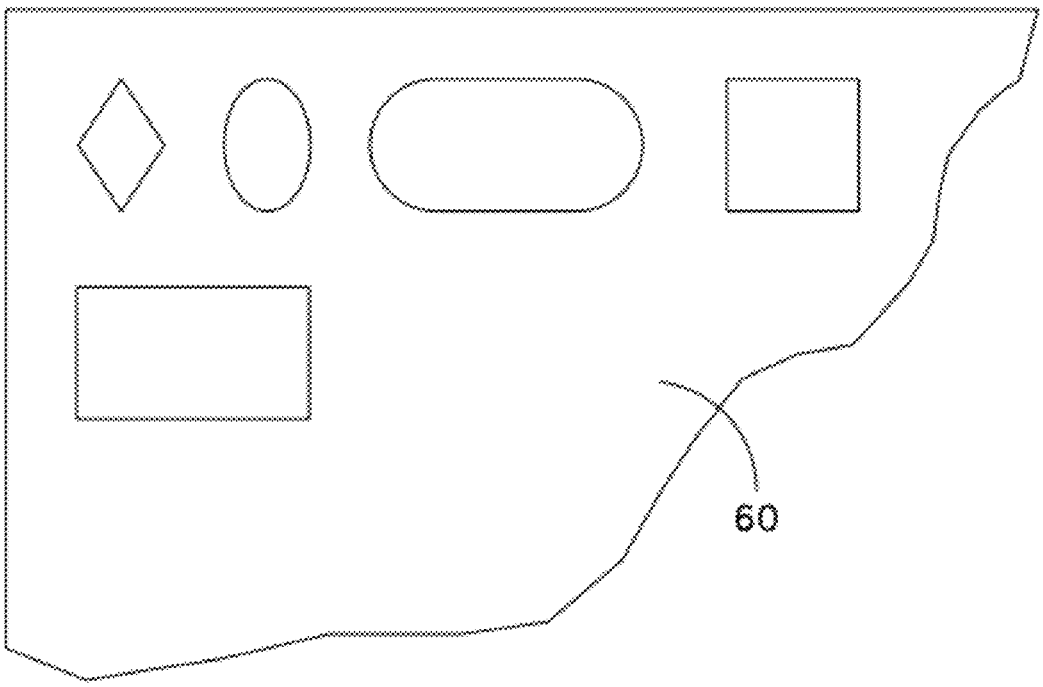
FIG. 19 is a view illustrating alternate versions of the mesh structure.

In the embodiments that are described herein, a limited number of fasteners have been illustrated. It is understood that any number of different types of fasteners may be used for securing the mesh structure in place as well as for securing the mesh structure to the chimney structure. Also, one particular mesh structure is illustrated herein. However, it is understood that various other types of similar structures may be employed. For example, a welded wire cloth may be employed or a woven wire cloth. The square shaped apertures shown in the illustrated embodiment may provide openings of one-quarter inch or one-half inch. The gauge of the metal wire for the mesh structure may be 16 gauge or larger. Reference is now made to FIG. 19 for a schematic illustration of a mesh structure 60 that is illustrative of the different types of apertures that may be provided by providing apertures in a metal sheet. As illustrated in FIG. 19, these various apertures may have shapes of a circle, oval, rectangle, square, or a diamond shape. Also, variations of the apertures illustrated in FIG. 19 may be employed with the principles of the present invention.

It is evident from the description of the preferred embodiments that the objects of the present invention are attained by providing a chimney cap that has, inter alia, an adjustable diameter mesh structure. Although the invention has been illustrated and described in detail, it is to be clearly understood that the same is by way of illustration an example only and is not to be taken by way of limitation. Although the present invention has been disclosed in multiple embodiments, it is understood that other means are also contemplated as falling within the scope of the present invention. The spirit and scope of this invention is to be limited only by the following appended claims.

What is claimed is:

1. A chimney cap capable of being secured to a chimney or flue and comprising:

a base;

an annular collar member for insertion into the chimney, having an outer circumference smaller than an opening of the chimney or flue and adapted to be received therein;

an annular shaped mesh member that is supported about the collar;

a top supported over the base;

a plurality of radial support rods attached to the collar and for the purpose of supporting the annular shaped mesh member;

the annular shaped mesh member having discharge openings for air flow and at least one elongated slot through which one of the support rods extends for securing the annular shaped mesh member;

the elongated slot in combination with the one support rod enabling adjustment of the diameter of the annular shaped mesh member by circumferentially moving a first end of the annular shaped mesh member over a second overlapping end of the annular shaped mesh member.

2. The chimney cap according to claim 1 wherein the annular shaped mesh member comprises a mesh grid pattern having openings that are square or rectangular.

3. The chimney cap according to claim 2 wherein the elongated slot is formed by an elongated opening that extends across several squares or rectangles of the discharge openings.

4. The chimney cap according to claim 3 wherein the elongated slot extends circumferentially about a portion of the total circumference of the annular shaped mesh member.

5. The chimney cap according to claim 4 wherein the annular shaped mesh member has opposed ends that overlap and that have at each end thereof aligned elongated slots that, once overlapped, define the elongated slot of the annular shaped mesh member.

6. The chimney cap according to claim 1 wherein the end slots terminate short of the opposed ends of the annular shaped mesh member.

7. The chimney cap according to claim 1 wherein said annular collar member has an overlap joint.

8. The chimney cap according to claim 7 wherein said overlap joint includes a lower segment that extends substantially longitudinal of said collar member and a top segment that extends diagonal to said lower segment enabling compression of the diameter of said collar member.

9. The chimney cap according to claim 1 including means for securing an inner end of each support rod to the collar, and a clip for securing an outer end of each support rod to a fixed chimney structure.

10. A chimney cap capable of being secured to a chimney and comprising:

an annular collar member for insertion into the chimney, having an outside circumference smaller than an opening of the chimney and for enabling support of the annular collar member in the chimney;

a base having a central opening that is fitted over the annular collar member and that is disposed about the annular collar member between respective top and bottom ends of the annular collar member;

an annular open member that is adapted for support over the chimney and under the base;

a top supported over the base;

the annular open member having plural apertures for the passage of exhaust gas from the chimney;

a plurality of support posts attached at one end thereof to the collar and extending radially from the annular collar member;

the annular open member further having at least one elongated slot through which one of the support posts extends for holding the annular open member in place;

the elongated slot in combination with the at least one support rod enabling adjustment of the diameter of the annular open member by circumferentially moving a first end of the annular shaped mesh member over a second overlapping end of the annular shaped mesh member.

11. The chimney cap according to claim 10 including a top supported over the base by means of a plurality of spacers.

12. The chimney cap according to claim 10 wherein the annular collar member has an overlap joint including a lower segment that extends substantially longitudinal of the collar member and a top segment that extends diagonal to the lower segment enabling compression of the diameter of the collar member.

13. The chimney cap according to claim 10 wherein the annular open member comprises a mesh grid pattern having openings that are square or rectangular.

14. The chimney cap according to claim 13 wherein the elongated slot is formed by an elongated opening that bridges several of the apertures and wherein the elongated slot extends circumferentially about a portion of the total circumference of the annular open member.

15. The chimney cap according to claim 14 wherein the annular open member has opposed ends that overlap and that have at each end thereof aligned elongated slots that, once overlapped, define the elongated slot of the annular shaped mesh member.

16. The chimney cap according to claim 15 wherein the elongated slots terminate short of the opposed ends of the annular open member, leaving at least one aperture at each end.

17. The chimney cap according to claim 10 including means for securing an inner end of each support post to the annular collar member, and a clip for securing an outer end of each support post to the chimney.

18. The chimney cap according to claim 17 wherein the clip includes a first fastener to secure the clip with the support post and a second fastener for securing the clip with the chimney.

19. The chimney cap according to claim 18 wherein there are at least three support posts disposed radially about the annular collar member.

20. The chimney cap according to claim 10 wherein the annular open member has apertures that are any one of square, rectangular, oval, circular, and diamond-shaped.

* * * * *